US007112147B2

(12) United States Patent
Solheim et al.

(10) Patent No.: US 7,112,147 B2
(45) Date of Patent: Sep. 26, 2006

(54) GOLF CLUB HEAD HAVING AN INSERT CAVITY REAR APERTURE

(75) Inventors: John Solheim, Phoenix, AZ (US); David Jones, Glendale, AZ (US); Derek Haines, Cave Creek, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 10/693,382

(22) Filed: Oct. 23, 2003

(65) Prior Publication Data

US 2005/0090327 A1 Apr. 28, 2005

(51) Int. Cl.
*A63B 53/04* (2006.01)

(52) U.S. Cl. ..... 473/340; 473/342

(58) Field of Classification Search ..... 473/329, 473/332, 342

See application file for complete search history.

(56) References Cited

U.S. PATENT DOCUMENTS

| | | | | | |
|---|---|---|---|---|---|
| 922,444 | A * | 5/1909 | Youds | 473/342 |
| 5,190,290 | A * | 3/1993 | Take | 473/342 |
| 5,332,214 | A * | 7/1994 | Tucker, Sr. | 473/329 |
| 5,425,535 | A * | 6/1995 | Gee | 473/300 |
| 5,437,447 | A * | 8/1995 | Rigutto | 473/251 |
| 5,460,377 | A * | 10/1995 | Schmidt et al. | 473/328 |
| 5,531,439 | A * | 7/1996 | Azzarella | 473/331 |
| 5,674,132 | A | 10/1997 | Fisher | |
| 5,690,562 | A * | 11/1997 | Sturm | 473/340 |
| 5,921,871 | A * | 7/1999 | Fisher | 473/329 |
| 5,924,939 | A * | 7/1999 | Grace et al. | 473/324 |
| 6,227,986 | B1 * | 5/2001 | Fisher | 473/342 |
| 6,231,458 | B1 * | 5/2001 | Cameron et al. | 473/332 |
| 6,238,302 | B1 | 5/2001 | Helmstetter et al. | |
| 6,375,583 | B1 | 4/2002 | Solheim | |
| 6,441,098 | B1 * | 8/2002 | Halko et al. | 525/261 |
| 6,478,694 | B1 | 11/2002 | Anderson et al. | |
| 6,729,972 | B1 * | 5/2004 | Boord | 473/340 |

OTHER PUBLICATIONS

"Silicones", Kirk-Othmer Encyclopedia of Chemical Technology, copyright 1997 and post Dec. 2002.*

* cited by examiner

*Primary Examiner*—Eugene Kim
*Assistant Examiner*—Alvin A. Hunter, Jr.
(74) *Attorney, Agent, or Firm*—Darrell P. Marquette; John D. Titus

(57) ABSTRACT

A golf club head includes a body having a front face with a cavity formed therein. The cavity has at least one aperture passing through the cavity bottom wall to the rear surface of the club head body. A face insert is installed in the cavity by applying an adhesive layer between the face insert and the bottom of the cavity. As the face insert is pressed into the cavity, air and any excess adhesive escapes through the aperture to the rear surface of the club where it can easily be removed by wiping with solvent.

1 Claim, 4 Drawing Sheets

GOLF CLUB HEAD HAVING AN INSERT CAVITY REAR APERTURE

BACKGROUND OF THE INVENTION

This invention relates generally to golf equipment and, in particular, to a golf club head having a cavity for receiving a face insert.

U.S. Pat. No. 6,238,302 to Helmstetter, et al. ("the '302 patent") discloses a golf club head with a polymer face insert. The face insert is disposed in a cavity formed in the club head face. The insert has a plurality of tabs formed on its perimeter edge that engage the walls of the cavity to center the insert in the cavity. The insert is installed by bonding it to the club head using an adhesive disposed in the cavity. During assembly, as the insert is placed in the cavity, the tabs permit air and any excess adhesive to escape the cavity though the gaps between the tabs, thereby promoting a good structural bond between the insert and the golf club head. Any excess adhesive that flows out of the cavity can simply be removed by wiping the surface of the insert before the adhesive cures. One drawback of the golf club head disclosed in the '302 patent is that the delicate features of tabs on the polymer insert are difficult to form by conventional processes other than expensive laser cutting.

SUMMARY OF THE INVENTION

The present invention comprises a golf club head including a body having a front face with a cavity formed therein. The cavity is defined by a bottom wall and a side wall, and has at least one aperture passing through the bottom wall to the rear surface of the club head body. A face insert is mounted in the cavity. In an illustrative embodiment of the present invention, the face insert is mounted by applying an adhesive layer between the face insert and the cavity. As the face insert is pressed into the cavity, air and any excess adhesive escapes through the cavity aperture to the rear surface of the club where it can easily be removed, for example by wiping with solvent. The insert itself may be formed with a continuous lip extending outward from the perimeter surface of the face insert. The lip is sized and shaped to form a close-tolerance fit with the side wall of the cavity. The close fit ensures that no liquid adhesive escapes to the front side of the cavity to mar the club face. The face insert may be solid, or may include a rearward facing cavity containing a second insert made of a different material. The apertures in the back of the cavity may be of regular cross-section, or may be in the form of letters of the alphabet, for example, to spell out the manufacturer's name or for aesthetic purposes.

BRIEF DESCRIPTION OF THE DRAWING

The present invention will be better understood from a reading of the following detailed description, taken in conjunction with the accompanying drawing figures in which like references designate like elements, and in which.

DETAILED DESCRIPTION

Figure 1:
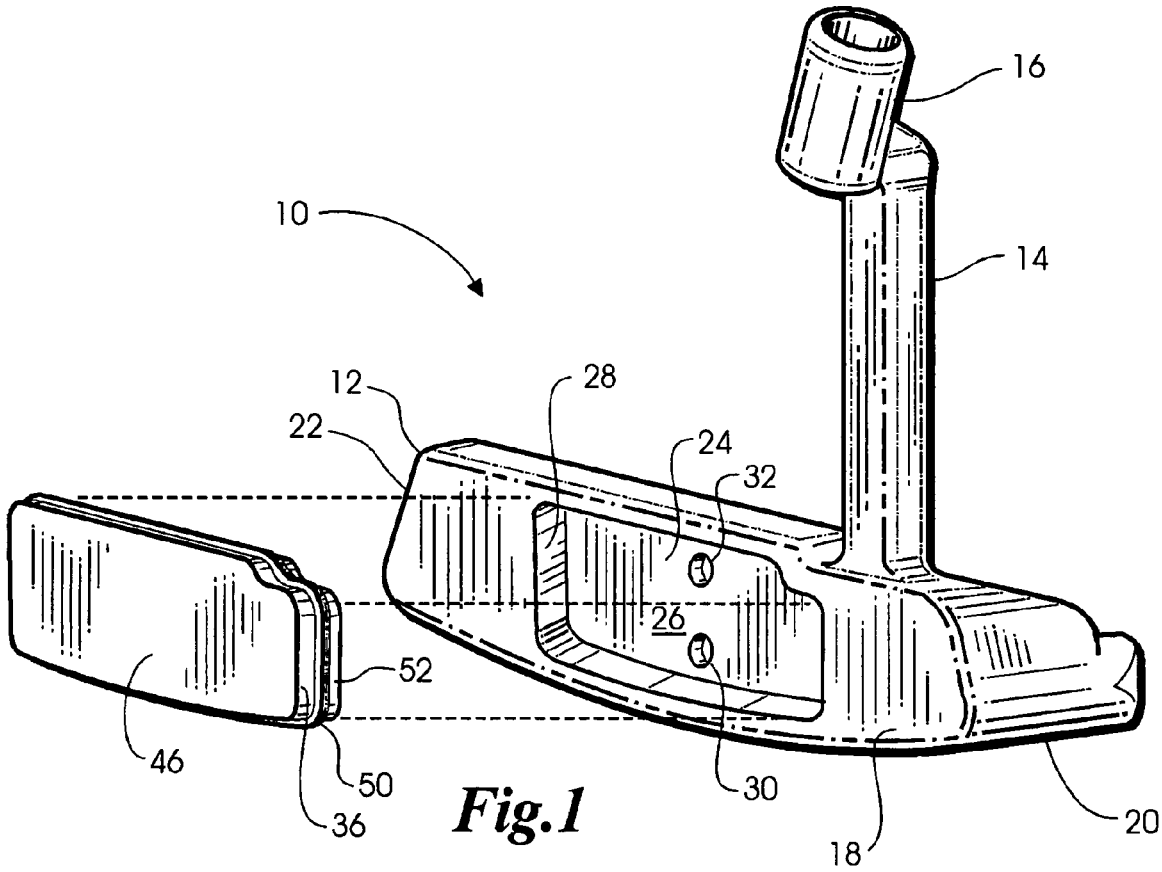
FIG. 1 is a front exploded perspective view of a golf club head including features of the present invention.
Figure 2:
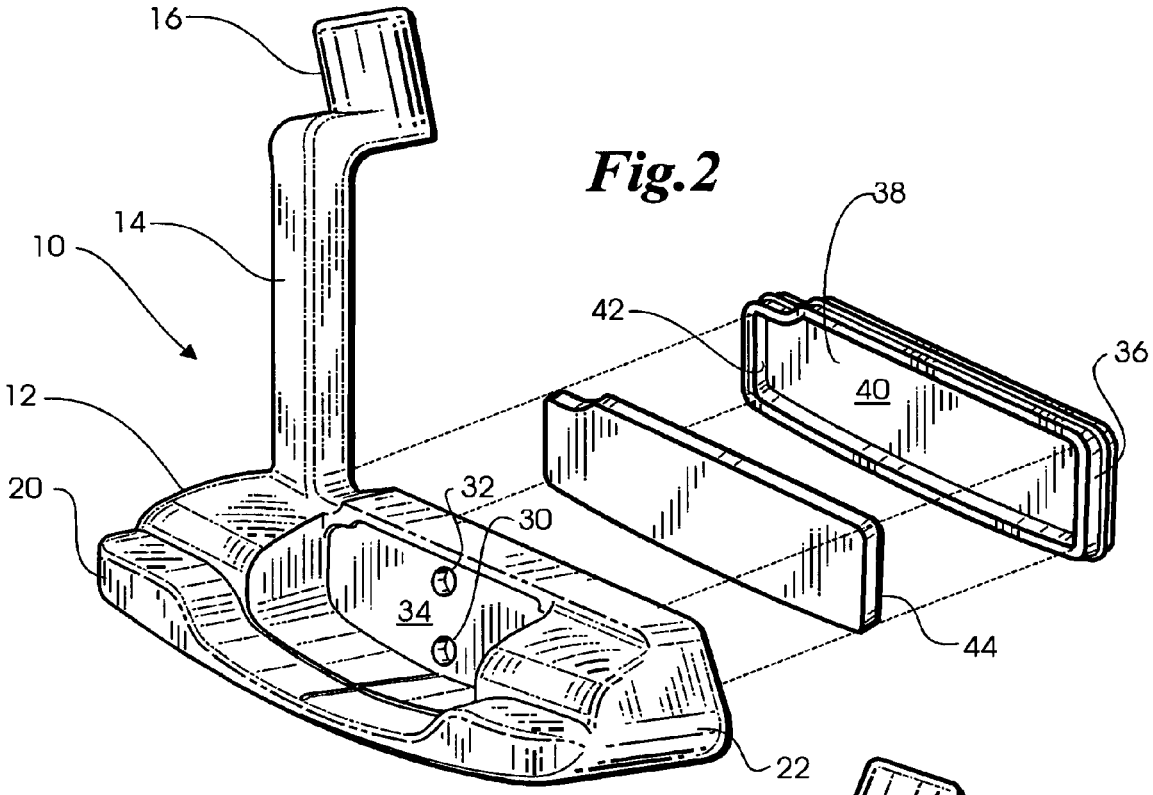
FIG. 2 is a rear exploded perspective view of the golf club head of FIG. 1.
Figure 3:
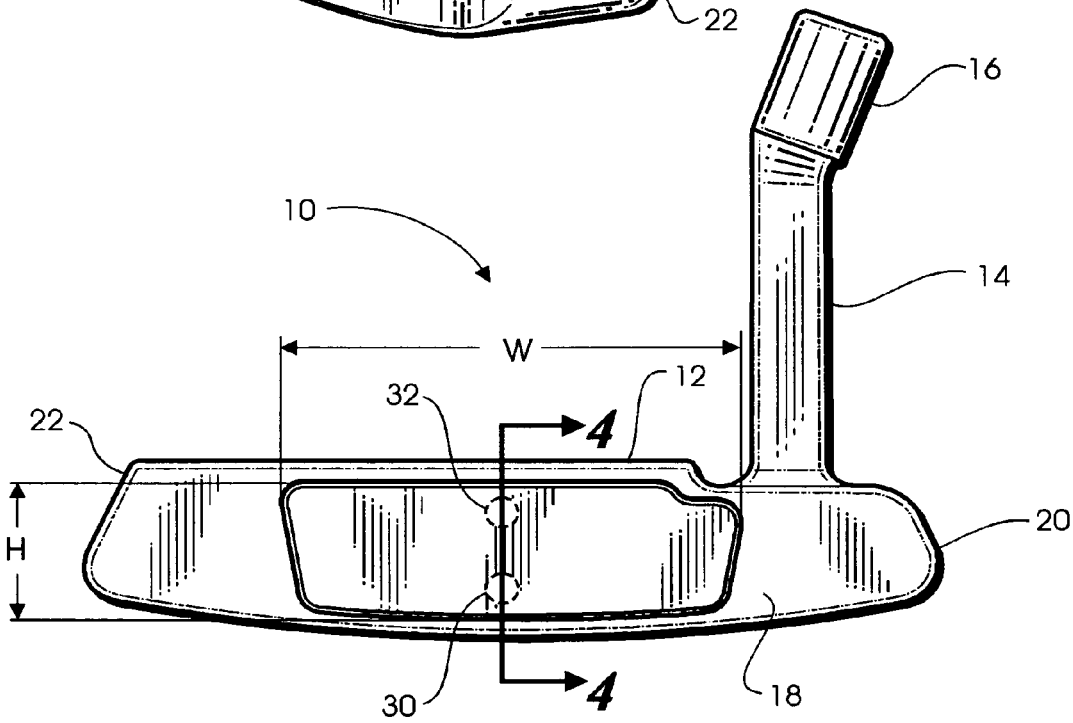
FIG. 3 is a front elevational view of the golf club head shown in FIG. 1.

With reference to FIGS. 1 and 2, a golf club head 10, preferably a golf putter head, comprises a body 12 and a hosel 14 with a boss 16, counterbored for receiving one end of a golf club shaft (not shown). The body 12 has a front face 18, a heel end 20 and a toe end 22. The front face 18 has a first cavity 24 formed therein defined by a bottom wall 26 and side wall 28. The first cavity 24 has a first aperture 30 and a second aperture 32 passing from first cavity 24 through bottom wall 26 to rear surface 34 of body 12.

The body 12, including the first cavity 24, is typically formed by an investment casting process. The bottom wall 26 and side wall 28 along with apertures 30 and 32 are then shaped by a milling process to maintain precise tolerances. A first insert hereinafter referred to as a face insert 36 is disposed in the first cavity 24. The body 12 is preferably made of a suitable metal such as steel, and the face insert 36 is preferably made of a polymer, more preferably an elastomeric polymer such as polyurethane. In the illustrative embodiment, the face insert 36 is made of a polyurethane manufactured by BASF under the trademark ELASTOLLAN which is an elastomeric polyurethane having a density of 1.14 grams per cubic centimeter and a Shore A hardness of 98. Optionally, face insert 36 has a second cavity 38 formed therein which is defined by a bottom surface 40 and a side surface 42.

A second insert hereinafter referred to as a back cavity insert 44 is disposed in the second cavity 38. Back cavity insert 44 is preferably formed of a polymer having a hardness (durometer) and/or resiliency that is different from that of the face insert 36. In the illustrative embodiment, the back cavity insert 44 is made of a silicone dielectric gel, silicone rubber, or other highly resilient elastomer. The face insert 36 is formed by an injection molding process with a maximum width "W" of approximately 2.300 inches and a maximum height "H" of approximately 0.725 inch. The face insert 36 also has a thickness "T" of approximately 0.200 inch measured between the front surface 46 and back surface 48. The first cavity 24 has a depth of approximately 0.215 inch as measured between the front face 18 and the cavity bottom wall 26. The second cavity has a depth of approximately 0.100 inch measured between the back surface 48 and the bottom surface 40 of second cavity 38.

Face insert 36 further includes a continuous lip 50 extending outward from perimeter edge 52 of face insert 36. Lip 50 is sized and shaped to form a close-tolerance fit with the side wall 28 of the first cavity 24 for reasons that are more fully explained hereinafter. Back cavity insert 44 may be cured in place within second cavity 38 or may be separately molded and attached by conventional means (e.g., adhesive) within second cavity 38.

Figure 4:
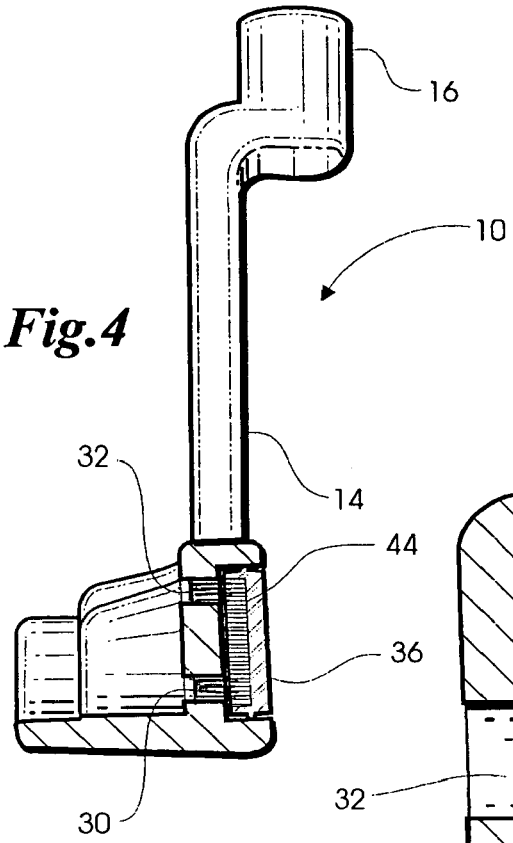
FIG. 4 is a sectional view taken along lines 4—4 of FIG. 3.

With reference to FIG. 4, according to one embodiment, back cavity insert 44 itself comprises an elastomeric adhesive. The club head 10 is assembled by filling second cavity 38 with the uncured elastomeric adhesive and inserting the face insert into first cavity 24. As face insert 36 is pressed into first cavity 24, excess adhesive and air that would otherwise be trapped within first cavity 24 escapes through first and second apertures 30 and 32 allowing face insert 36 to seat fully against bottom wall 26 of first cavity 24.

Figure 5:
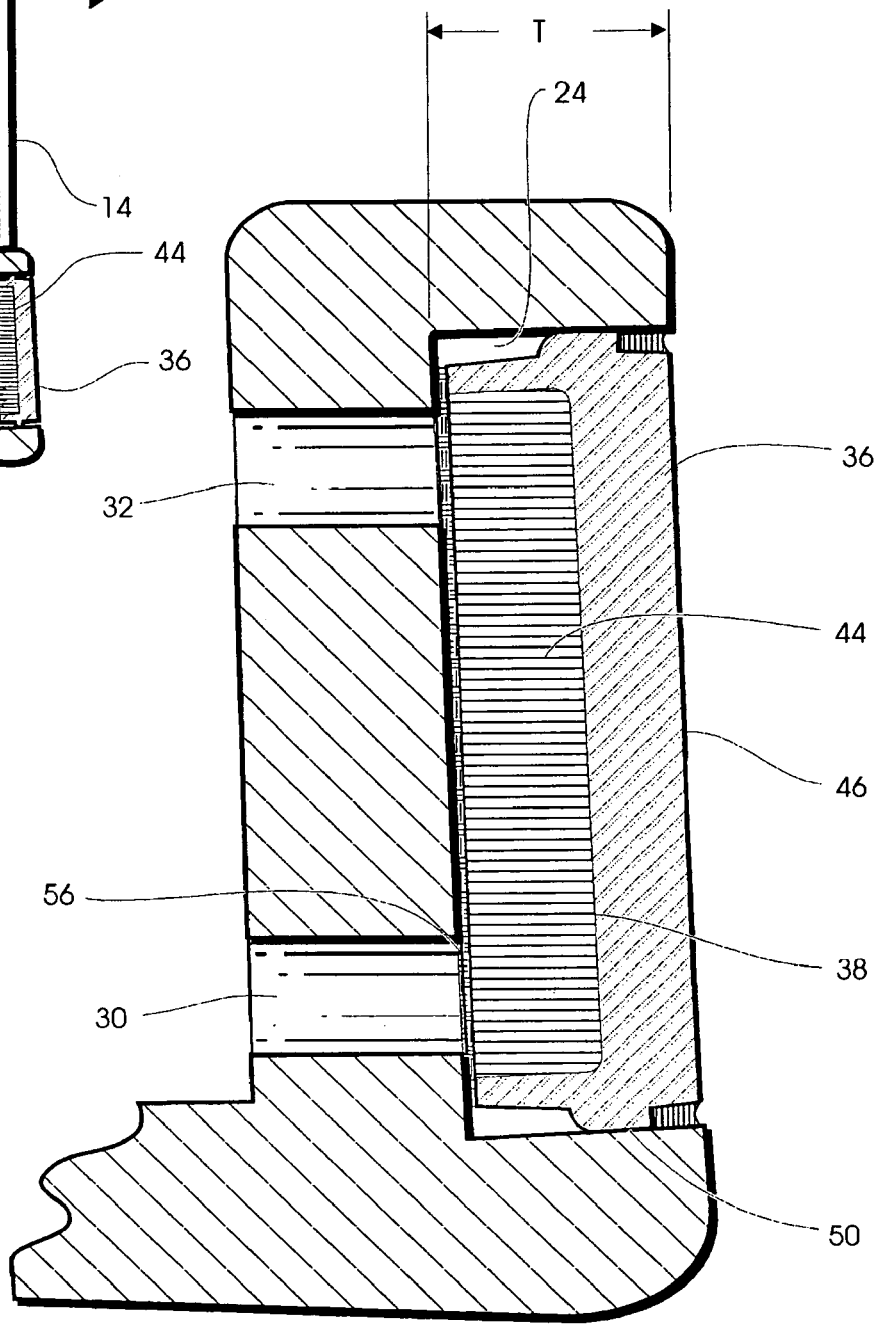
FIG. 5 is an enlarged sectional view similar to FIG. 4 showing an alternative embodiment.

Alternatively, as shown in FIG. 5, back cavity insert 44 is cured in place or attached by conventional means such as an adhesive layer within second cavity 38. Face insert 36 is thereafter attached to body 10 by adhesive means such as a liquid adhesive as described above or by using double sided tape 56, preferably a double coated acrylic foam or adhesive transfer film manufactured by 3M Company that is disposed between back cavity insert 44 and bottom wall 26 of first cavity 24. In the illustrative embodiment of FIG. 5, double sided adhesive tape 56 is applied to exposed surface 58 of back cavity insert 44 before face insert 36 is installed in body 12. Double sided adhesive tape 56 is approximately 0.015 inch thick and is cut to a size and shape that matches exposed surface 58. Double sided adhesive tape 56 may be cut so that one or the other of face insert 36 or back cavity insert 44 is exposed directly to apertures 30 and 32 for aesthetic reasons so that the back side of the insert 36 or 44 may be seen through the apertures 30, 32.

Figure 6:
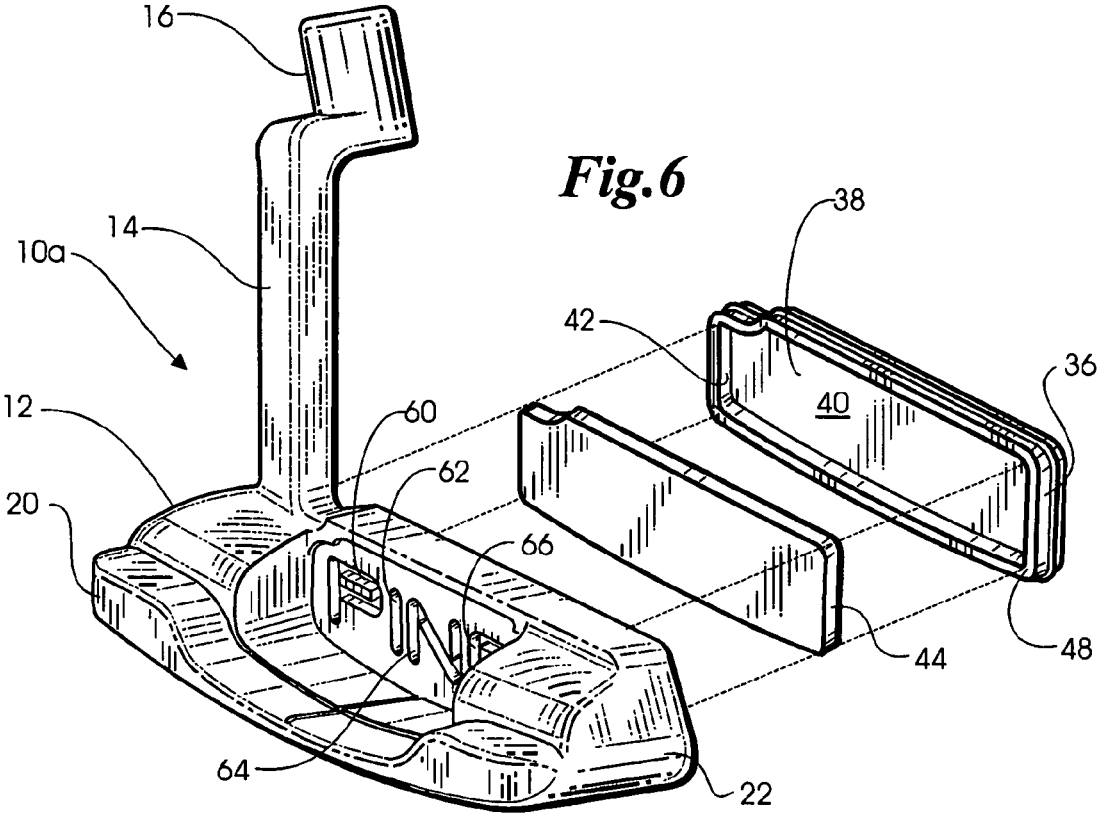
FIG. 6 is a rear exploded perspective view of an alternative embodiment of a golf club head incorporating features of the present invention.
Figure 7:
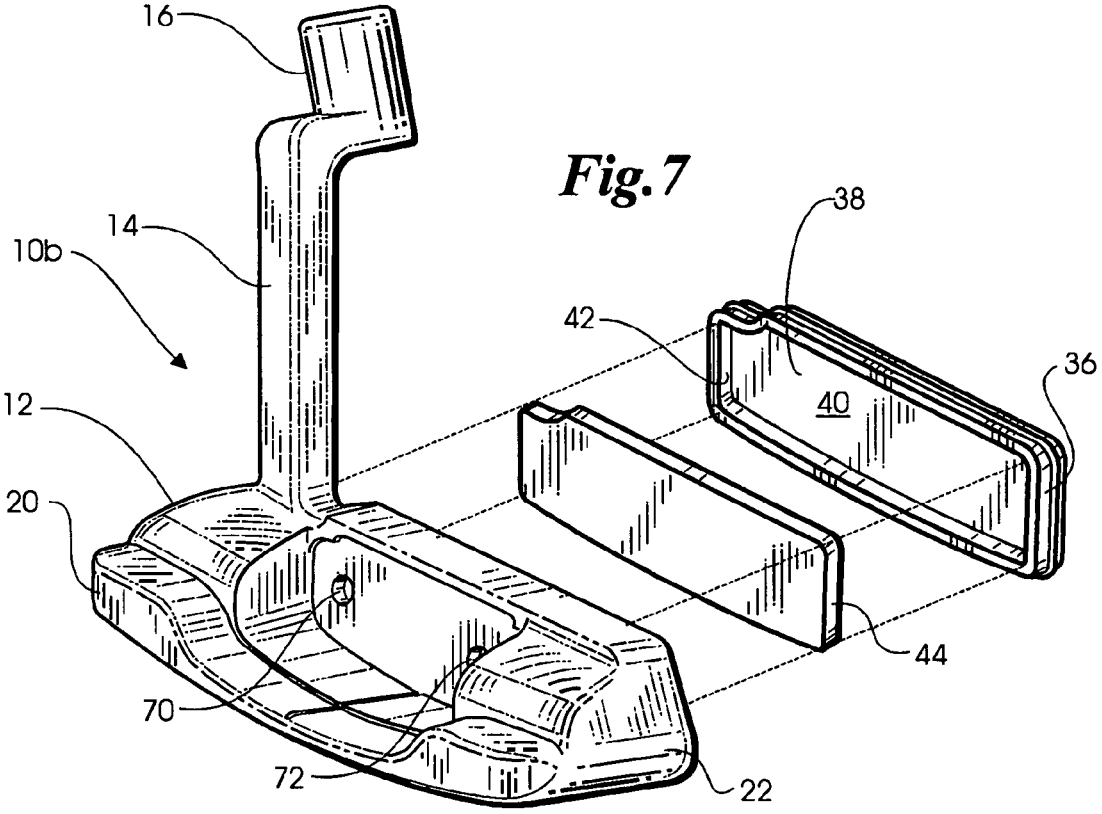
FIG. 7 is a rear exploded perspective view of yet another alternative embodiment of a golf club head incorporating features of the present invention.

As shown in FIG. 6, according to an alternative embodiment of a golf club head 10*a* incorporating features of the present invention, apertures 60, 62, 64 and 66 may be formed with cross-sections in the shape of letters of the alphabet, for example spelling out the manufacture's name for aesthetic purposes. Alternatively, as shown in the golf club head 10*b* of FIG. 7, apertures 70 and 72 are placed proximal heel end 20 and toe end 22, respectively. This arrangement of apertures 70, 72 permits face insert 36 to be installed and thereafter an adhesive is injected through one of apertures 70 and 72 until it flows out of the other of apertures 70 and 72. This process eliminates the need for using transfer adhesives or tapes while at the same time facilitating use of automated equipment for applying the adhesive.

Although certain illustrative embodiments and methods have been disclosed herein, it will be apparent from the foregoing disclosure to those skilled in the art that variations and modifications of such embodiments and methods may be made without departing from the spirit and scope of the invention. Accordingly, it is intended that the invention should be limited only to extent required by the appended claims and the rules and principals of applicable law.

What is claimed is:

1. A method of manufacturing a golf club comprising:

providing a club head body composed of a first material, the club head body having a rear surface and a front face with a cavity formed therein, the cavity being defined by a bottom wall and a side wall, the club head body further comprising a plurality of apertures passing from the cavity through the bottom wall thereof to the rear surface;

providing a face insert composed of a second material, the face insert comprising a body having a front surface, a back surface and a lateral surface;

applying an adhesive layer to one of the bottom wall of the cavity and the back surface of the face insert;

pressing the face insert into the cavity so that the adhesive layer contacts the bottom wall of the cavity and the back surface of the face insert further pressing the face insert into the cavity so that the adhesive layer is extruded through said plurality of apertures and any air trapped between the face insert and the bottom wall of the cavity escapes through said plurality of apertures and said face insert is attached to said club head body solely by the adhesive and without the use of mechanical fasteners;

wherein the face insert has a second cavity formed in the back surface thereof, said second cavity being defined by a perimeter surface and a planar bottom surface, and further comprising installing a cavity insert in the second cavity.

* * * * *